US006886283B2

(12) United States Patent
Arraut

(10) Patent No.: US 6,886,283 B2
(45) Date of Patent: May 3, 2005

(54) TRANSPARENT DOCUMENT HOLDER

(76) Inventor: Edward Arraut, 127 Wahie La., Lahaina, HI (US) 96761

( * ) Notice: Subject to any disclaimer, the term of this patent is extended or adjusted under 35 U.S.C. 154(b) by 0 days.

(21) Appl. No.: 10/430,453

(22) Filed: May 8, 2003

(65) Prior Publication Data

US 2004/0040194 A1 Mar. 4, 2004

Related U.S. Application Data

(60) Provisional application No. 60/407,226, filed on Aug. 29, 2002.

(51) Int. Cl.[7] ..... G09F 3/18

(52) U.S. Cl. ..... 40/661; 40/649; 40/654.01; 40/586; 283/75; 150/147; 150/148; 224/600; 224/623; 224/684; 224/257

(58) Field of Search ..... 40/643, 661, 649, 40/654.01, 586; 283/75, 76, 108, 109; 150/147, 148, 145; 229/71, 72; 224/191, 600, 623, 230, 683, 684, 249, 257; 206/39, 39.7

(56) References Cited

U.S. PATENT DOCUMENTS

| | | | | | |
|---|---|---|---|---|---|
| 1,153,094 | A | * | 9/1915 | McGinty | 150/149 |
| 1,683,996 | A | * | 9/1928 | Snow | 150/147 |
| 3,216,135 | A | * | 11/1965 | Wright | 40/649 |
| 3,355,826 | A | * | 12/1967 | Klein et al. | 40/1.5 |
| 3,655,119 | A | * | 4/1972 | Thompson | 229/72 |
| 3,657,834 | A | * | 4/1972 | Tauber | 229/71 |
| 3,858,790 | A | * | 1/1975 | Humphrey | 229/72 |
| 4,105,057 | A | | 8/1978 | Baumann et al. | |
| 4,571,867 | A | | 2/1986 | Williams | |
| 4,781,379 | A | * | 11/1988 | Parks | 150/147 |
| 4,890,728 | A | * | 1/1990 | Grimsley | 150/147 |
| 4,920,673 | A | | 5/1990 | Mitsuyama | |
| 4,921,027 | A | * | 5/1990 | Scheunemann | 150/147 |
| 5,482,509 | A | * | 1/1996 | Dull | 462/64 |
| 5,784,816 | A | | 7/1998 | Zapawa | |
| 6,108,957 | A | | 8/2000 | Zapawa | |
| 6,681,972 | B1 | * | 1/2004 | Tapocik | 150/147 |
| 2001/0054245 | A1 | * | 12/2001 | Williams | 40/661 |
| 2002/0108284 | A1 | * | 8/2002 | Wallin | 40/586 |
| 2003/0188815 | A1 | * | 10/2003 | Hart | 150/147 |
| 2003/0213156 | A1 | * | 11/2003 | Gregory | 40/661 |
| 2004/0016163 | A1 | * | 1/2004 | Lansing | 40/661 |

OTHER PUBLICATIONS

U.S. Appl. No. 60/366,742.*

* cited by examiner

*Primary Examiner*—Gary C. Hoge
(74) *Attorney, Agent, or Firm*—Edward Sokolski

(57) ABSTRACT

A document and card holder has a semi-rigid backing element. Flexible transparent sheets are mounted on the front and back sides of the backing element. Side and bottom edges of the transparent sheets are attached to the side and bottom edges of the backing element to form pouches for retaining documents and cards. Some of the pouches are formed by transparent sheets mounted over or directly on pouches which are mounted directly on the backing element. The pouches are made of different sizes to accommodate different size documents and cards. Bias cuts are formed in the tops of pouches to facilitate the installation and removal of documents and cards. Two backing elements having pouches installed thereon are hinged together so they can be folded over each other.

7 Claims, 7 Drawing Sheets

TRANSPARENT DOCUMENT HOLDER

This Application enjoys the priority of Provisional Application No. 60/407,226 filed Aug. 29, 2002.

BACKGROUND OF THE INVENTION

1. Field of the Invention

This invention relates to a document holder and more particularly to such a holder made of transparent sheeting which permits the user to view and show to others all of the documents contained therein without removing the documents from the holder.

2. Description of the Related Art

Especially when traveling, documents such as tickets, boarding passes, passports, return tickets, driver's licenses and other forms of identification need to be shown frequently prior to boarding aircraft, to immigration personnel, customs officials and at other security check points. Such documents are generally kept in separate holders such as wallets, passport holders, etc. Thus, such documents must be taken out of their holders each time they are presented or held in one's hand for some time which presents the hazard of their being lost or stolen.

Various holders have been developed in the prior art to overcome this problem such as the devices described in U.S. Pat. No. 4,920,673 issued May 1, 1990 to Mitsuyama and U.S. Pat. No. 5,784,816 issued Jul. 28, 1998 to Zapawa. While these prior art devices employ transparent ticket pockets for holding tickets, cards, or the like, they have certain shortcomings. The Mitsuyama patent has small slits formed therein which are only suitable for holding business cards or the like. This device is not adapted to hold a variety of items such as passports, tickets, etc. The Zapawa patent is adapted to hold a "memorabilia" card and a ticket or two. It does not have a plurality of different size pockets suitable for carrying a variety of different items and thus is limited in its utilization.

SUMMARY OF THE INVENTION

The device of the present invention overcomes the limitations of devices of the prior art by providing a transparent holder with a number of separate pouches, each for holding a different size and type of item, such items being held securely in place and fully visible to the user.

The pouches or containers of the device of the invention are fabricated of sheets of a durable flexible transparent material such as pvc and are mounted on a semi-rigid backing element. Bias cuts are provided in the top of certain pouches to facilitate the installation and removal of documents or other items stored therein. A horizontal cut is provided on the top of the front and back. Both sides of a single backing element have pouches formed thereon to make for a compact and easy to handle holder of economical and simple construction. The pouches are formed from transparent sheets, which may be of pvc, mounted on top of each other or directly on the backing element. The use of pouches on both sides of the holder makes it possible, for example to place tickets or the like needed for immediate use on one side and return tickets and other documents needed later on the other side. In some embodiments two backing elements with pouches formed thereon are hinged together so that they can be folded to form a single unit(for multiple family travelers)

It is therefore an object of this invention to provide a simple and economical document holder in which the documents can be seen while they remain in the holder.

It is a further object of this invention to provide a document holder capable of carrying a variety of different size and types of documents.

It is still a further object of this invention to provide a document holder having opposite sides containing pouches, each for holding documents needed at a different time.

Other objects of the invention will become apparent in view of the following description taken in connection with the accompanying drawings.

DETAILED DESCRIPTION OF THE INVENTION

Figure 2:
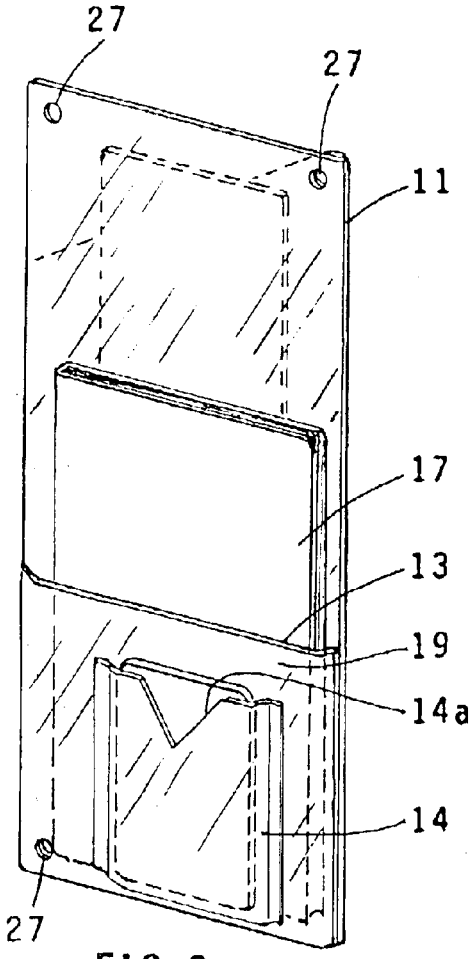
FIG. 2 is a front perspective view illustrating one side of a first embodiment of the invention.
Figure 3:
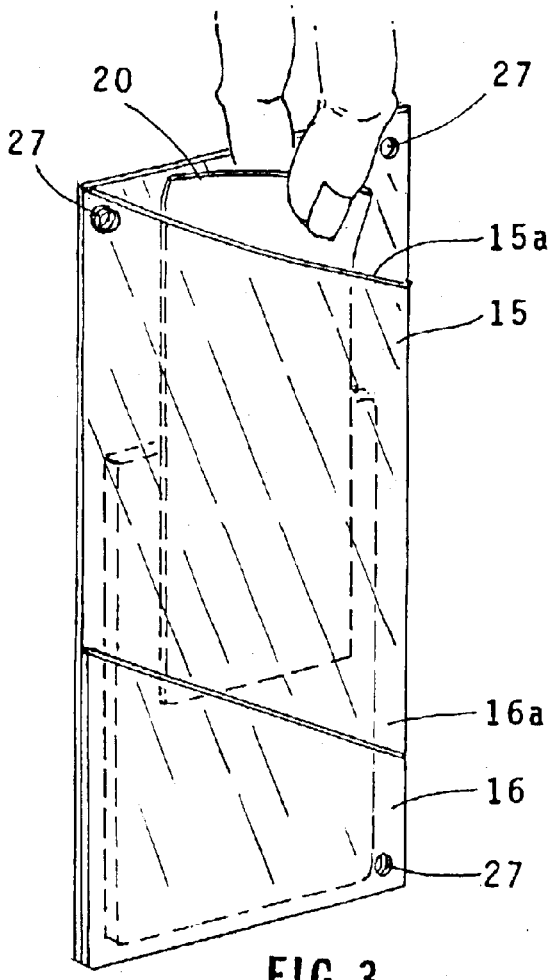
FIG. 3 is a perspective view illustrating the side of the first embodiment Opposite to that shown in FIG. 2.

Referring to FIGS. 2 and 3, a first embodiment of the invention is illustrated.

A rigid partially frosted backing sheet of plastic forms backing sheet 11 of the device. A transparent flexible plastic sheet 19 is attached along its side and bottom edges to the side and bottom edges of the backing sheet 11 to form a pouch 13, which is used to retain a document 17 such as a passport or visa. A second smaller pouch 14, having a finger notch 14*a* to facilitate the removal of the document contained therein, is formed by attaching the side and bottom edges of a transparent plastic sheet to the outer surface of pouch 19. Pouch 14 may be used to retain a smaller item such as a driver's license or ID card.

Referring now to FIG. 3, a long pouch 15 is formed over the rear side of backing sheet 11, which may be used for retaining a plane ticket 20 or other such long item. Pouch 15 is formed in the same manner as pouch 19, i.e. by attaching the side and bottom edges of a transparent sheet to the side and bottom edges of the backing sheet. A bias cut 15*a* is formed in the top of pouch to facilitate the removal of an item therefrom. Ample space is provided in pouch 15 for retaining tickets of various lengths. The friction along the walls of the pouch keeps smaller tickets from falling to the bottom. An additional pouch 16 formed from a transparent sheet having a bias cut 16*a* at its top is mounted over the front surface of pouch 15 to retain another item, if need may be. Two holes 27 are formed in the top portion of the device through which a cord can be installed for use in hanging the device around the user's neck.

It is to be noted that pouches 14 and 16 are formed by sheets of transparent plastic which overlay pouches 19 and 15, respectively. The bottom and side edges of pouch 16 are attached to the bottom and side edges of pouch 15, while the side and bottom edges of pouch 14 are attached to the top surface of pouch 19.

Figure 1:
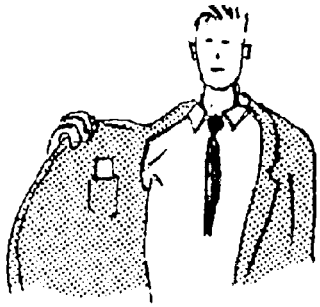
FIG. 1 is a front elevational view showing the device of the invention placed in the inside pocket of a user.

Referring to FIG. 1, the holder of the invention is shown installed in the inside packet of a user's jacket.

Figure 4:
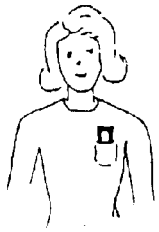
FIG. 4 is a front plan view illustrating the device of the invention placed in a Wearer's outside blouse pocket.
Figure 5:
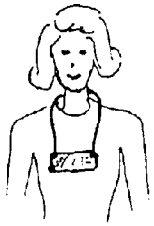
FIG. 5 is a front plan view illustrating the device of the invention held on a cord in a horizontal orientation around the neck of a user.
Figure 6:
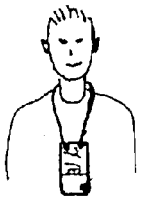
FIG. 6 is a front plan view illustrating the device of the invention held on a card in a vertical orientation around the neck of the user.
Figure 7:
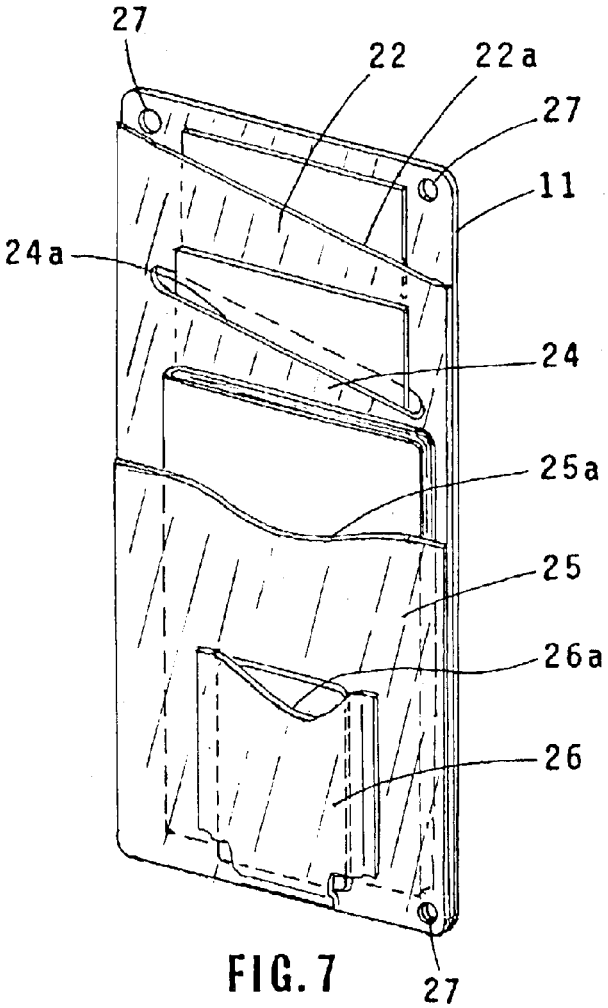
FIG. 7 is a front perspective view of a second embodiment of the invention.
Figure 8:
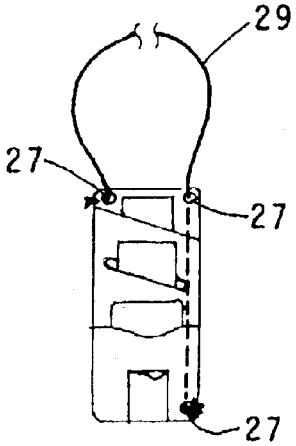
FIG. 8 is a front plan view showing the second embodiment with a cord connected thereto for suspension around a user's neck in a vertical orientation.
Figure 9:
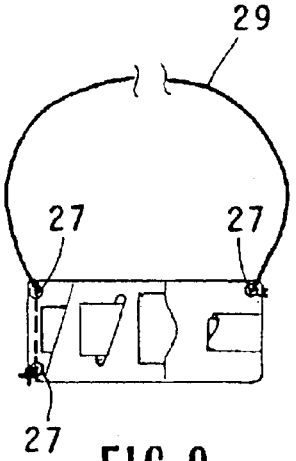
FIG. 9 is a front plan view showing the second embodiment with a cord connected thereto for suspension around a user's neck in a horizontal orientation.

Referring now to FIG. 7, a second embodiment of the invention is shown. This embodiment, similarly to the first embodiment has a rigid frosted backing sheet 11. In this embodiment there are only pouches on one side which are formed in he same manner as in the first embodiment. These pouches include a relatively long pouch 22 having a bias cut 22*a* for firmly holding plane tickets or the like; a second pouch 24 having a bias cut 24*a* for holding a visa or boarding pass; a third wide pouch 25 having an indented cut 25*a* for holding a passport; and a fourth pouch 26 formed over pouch 25 having an indented cut 26*a* for holding a driver's license or ID card. Holes 27 are formed in the top corners and one of the bottom corners through which a cord 29 can be installed either for vertical positioning around the user's neck as shown in FIGS. 6 and 8 or horizontal positioning as shown in FIGS. 5 and 9. FIG. 4 shows the device placed in the pocket of a user.

Figure 10:
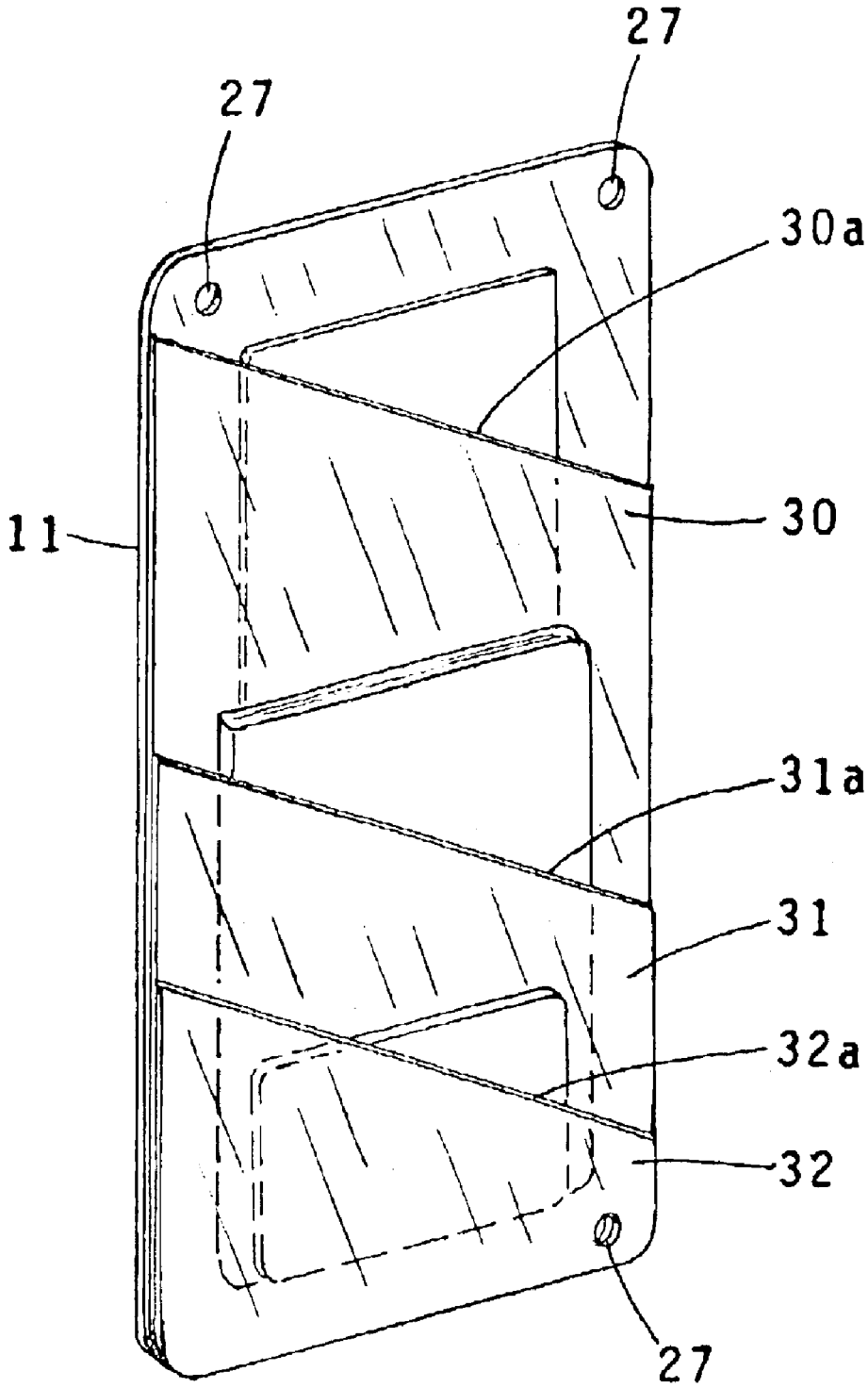
FIG. 10 is a front perspective view of a third embodiment of the invention.

Referring now to FIG. 10, a third embodiment of the invention is shown. As for the previous embodiments, the device is formed from a rigid plastic backing sheet 11 with pouches formed thereon in the same manner as in the previous embodiments. As for the second embodiment, this embodiment only has pouches on its front side. There are three pouches, 30, 31, and 32 each having a bias cut 30*a*, 31*a*, and 32*a*, respectively. As for the previous embodiments, pouch 31 can be used for carrying a passport, pouch 30 for carrying tickets and pouch 32 for a driver's license or ID card.

Figure 11:
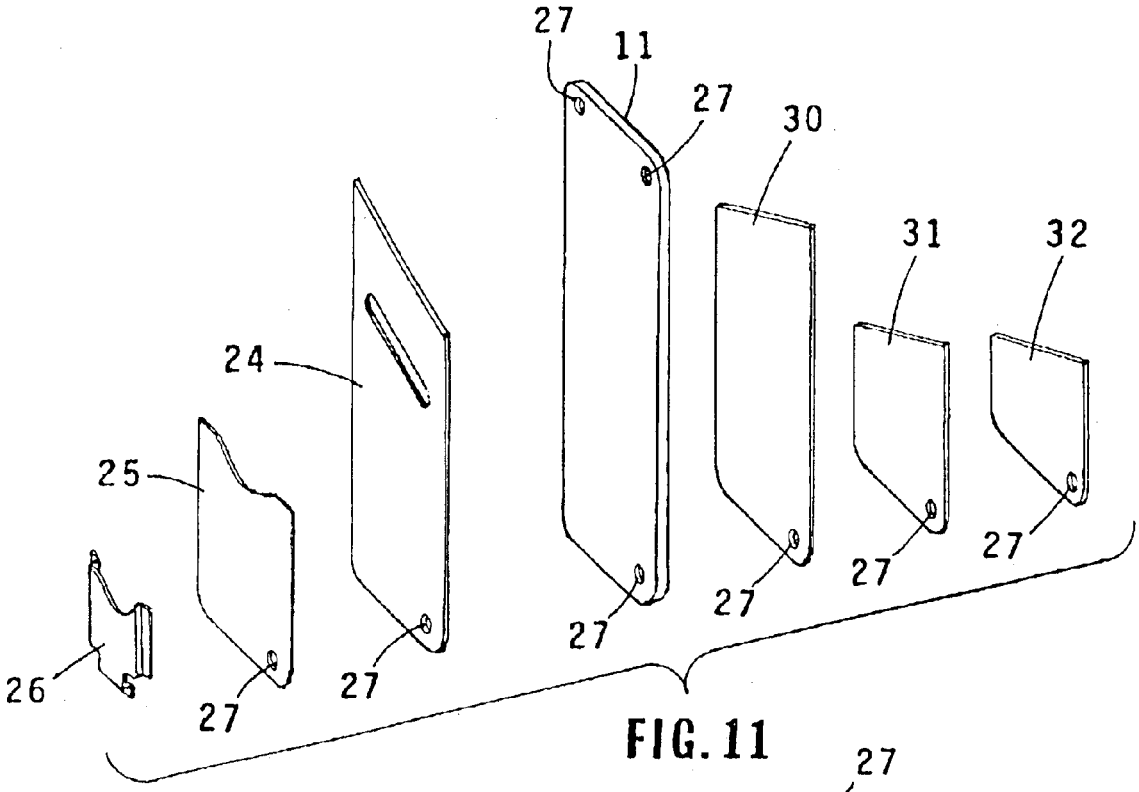
FIG. 11 is an exploded view of a fourth embodiment of the invention having the embodiment of FIG. 7 on one side and the embodiment of FIG. 10 on the opposite side.
Figure 12:
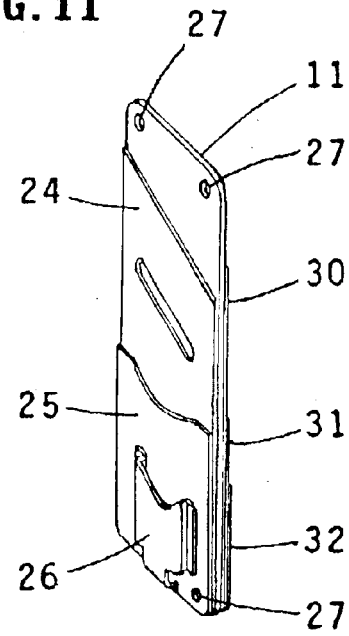
FIG. 12 is a side perspective view of the embodiment of FIG. 11.

Referring now to FIGS. 11 and 12, a fourth embodiment of the invention is illustrated. This embodiment is a combination of the second and third embodiments with the device of the second embodiment (FIG. 7) being formed on the front side of the device and the device of the third embodiment (FIG. 10) being formed on the back side of the device. Otherwise, the device of this embodiment is the same as the previously described second and third embodiments. The exploded view of FIG. 11 shows the way in which the pouches are formed from separate transparent sheets.

Figure 13:
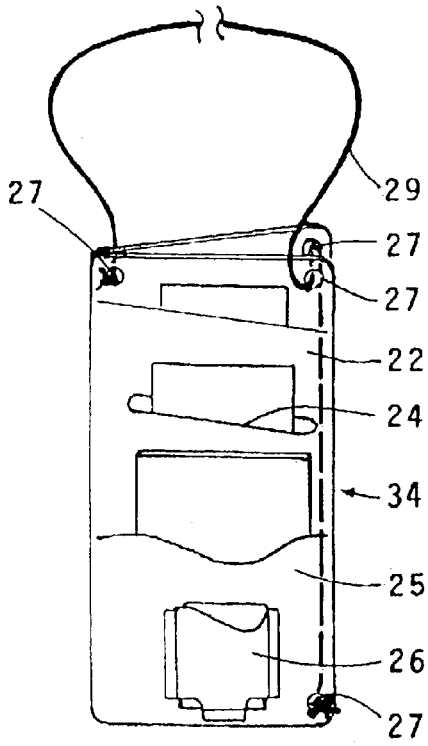
FIG. 13 is a front plan view of a fifth embodiment of the invention.
Figure 14:
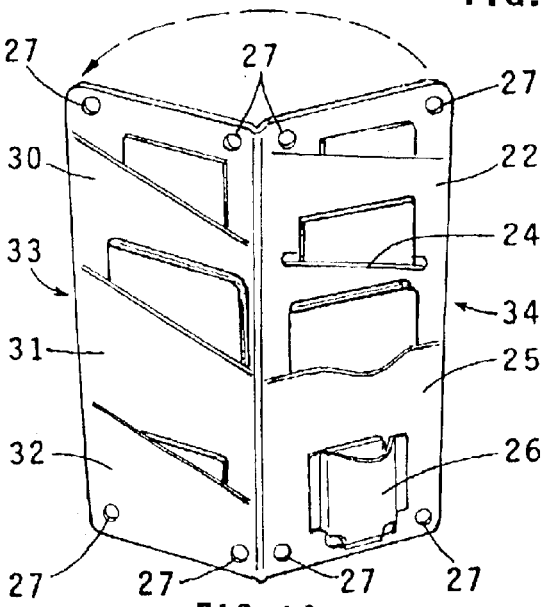
FIG. 14 is a front perspective view of the fifth embodiment shown in a first open position.
Figure 15:
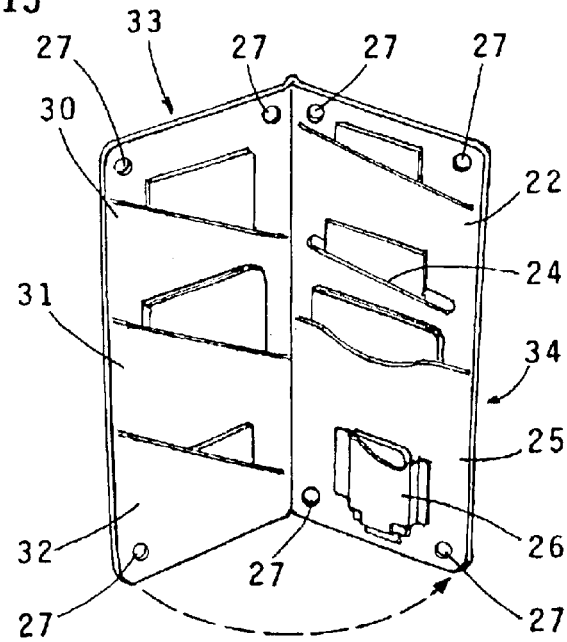
FIG. 15 is a front perspective view of the fifth embodiment shown in a second open position.

Referring now to FIGS. 13–15, a fifth embodiment of the invention is illustrated. This embodiment combines the embodiments of FIGS. 7 and 10 with the devices of these two embodiments joined together in a hinged relationship to form a composite including at least two units. Additional units can be formed on the back sides of each unit as shown in FIG. 11.

Figure 16:
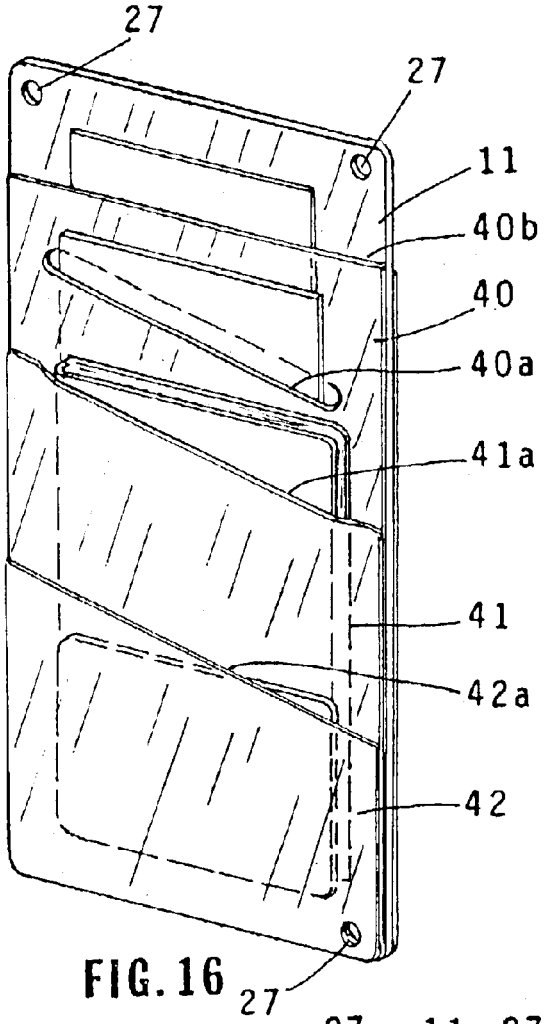
FIG. 16 is a front perspective view of a sixth embodiment of the invention.
Figure 17:
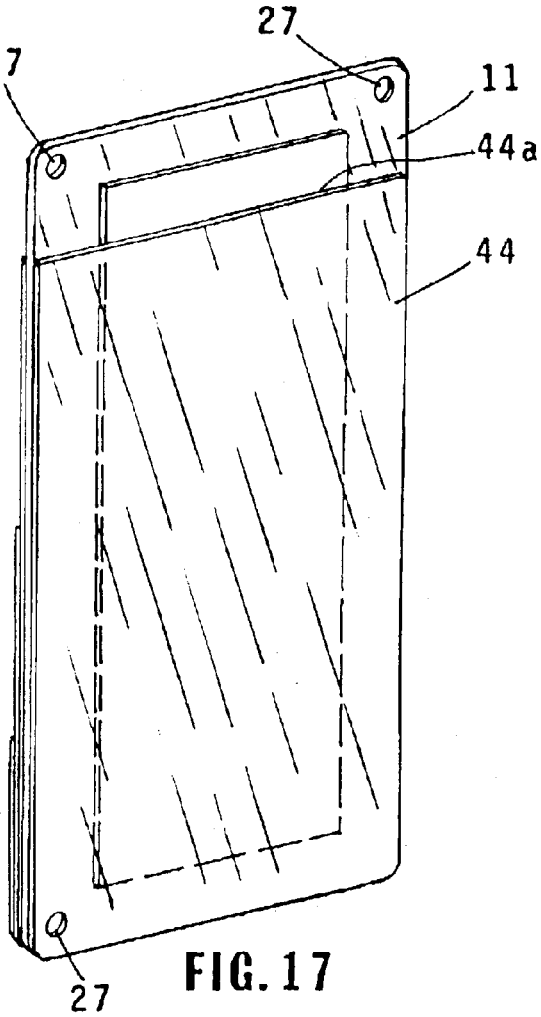
FIG. 17 is a rear perspective view of the sixth embodiment.
Figure 18:
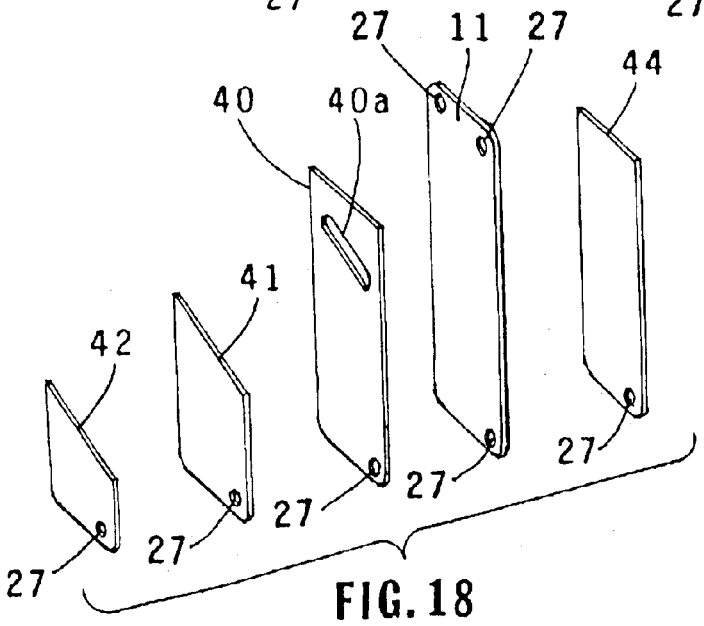
FIG. 18 is an exploded view of the sixth embodiment.

Referring now to FIGS. 16–18, a sixth embodiment of the invention is illustrated. This embodiment is formed is the same manner as the prior embodiments, but has a different arrangement of pouches. As can be seen in the FIGURES, this embodiment has a rigid backing sheet 11 with pouches 40, 41, and 42 on the front side which have bias cuts 40*a*, 40*b* and 40*c* formed therein and a single elongated pouch 44 on the back side. A slot 40*a* is provided in the side of container 40 for accepting an extra item.

Figure 19:
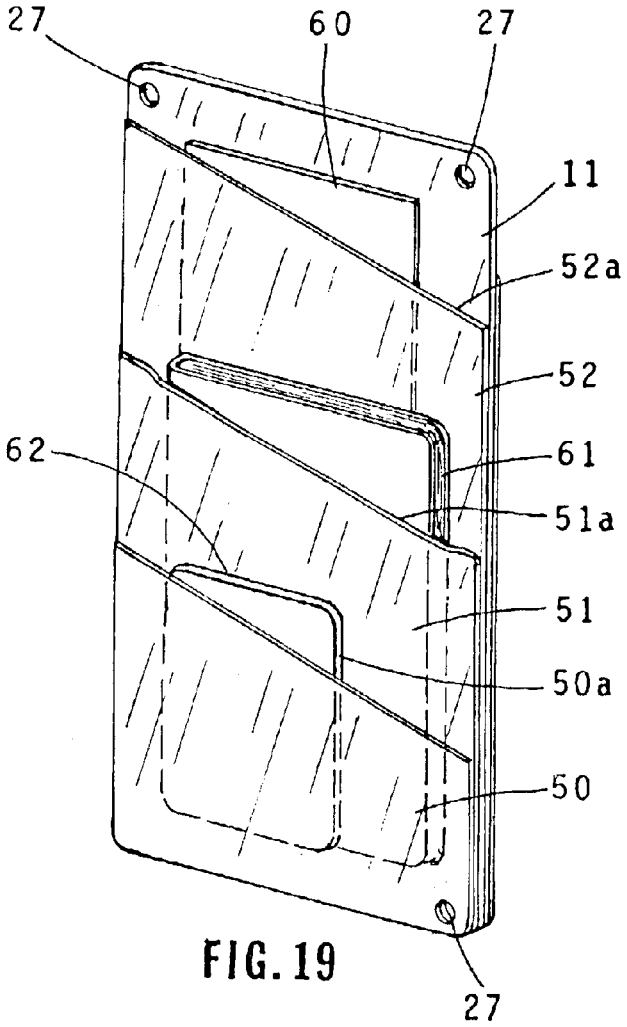
FIG. 19 is a front perspective view of a seventh embodiment of the invention.
Figure 20:
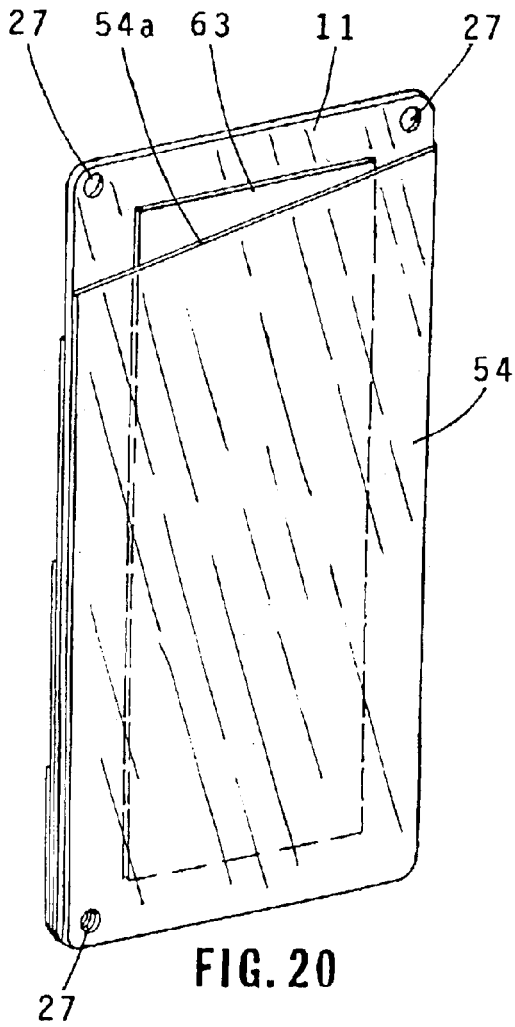
FIG. 20 is a rear perspective view of the seventh embodiment.

Referring now to FIGS. 19 and 20 a seventh embodiment of the invention is illustrated. This embodiment is particularly useful for an airline traveler. As in the previous embodiments, this embodiment has a rigid backing sheet 11. On the front side of the backing sheet, a top pouch 53 is provided for carrying an airplane boarding pass 60; a second pouch 52 is provided for carrying a passport 61 and two other pouches 50 and 51 provided for carrying cards, licenses, etc. 62. Each of the pouches has a bias cut 50*a*, 51*a* and 52*a*. The back side of the container has a single pouch 54 with a bias cut 54*a* for carrying return tickets, baggage claims, etc.

The device of this invention thus provides a document holder which facilitates the access to a variety of documents which may be used while traveling or even for day to day use. Documents are firmly held and can be viewed without the need to remove them from the holder in which they are retained.

While the invention has been described and illustrated in detail, it is to be clearly understood that this is intended by way of illustration and example only and not by way of limitation, the scope and limitation of the invention being determined by the terms of the following claims.

I claim:

1. A holder for retaining documents and cards comprising:

A backing element which is at least semi-rigid; apertures being formed in said backing element;

a cord fitted through said apertures for supporting said holder around the user's neck, said apertures being positioned to enable either lateral or vertical positioning of said holder;

a first transparent flexible sheet mounted on one side of said backing element with its side and bottom edges attached to the side and bottom edges of said backing element; and A second transparent flexible sheet mounted over a portion of said first sheet with its side and bottom edges attached to the side and bottom edges of said backing element;

said transparent flexible sheets forming pouches for retaining said documents and cards.

2. The holder of claim 1 and further including a third transparent flexible sheet mounted on a portion of said second sheet with its side and bottom edges attached to said second sheet, said third transparent sheet forming a pouch for retaining documents or cards.

3. The holder of claim 1 wherein said pouches have bias cuts in the top edges thereof.

4. The holder of claim 1 wherein at least one of said pouches has an indented cut formed in the top edge thereof.

5. A holder for retaining documents and cards comprising:

a backing element which is at least semi-rigid;

a first transparent flexible sheet mounted on one side of said backing element with its side and bottom edges attached to the side and bottom edges of said backing element;

a second transparent flexible sheet mounted over a portion of said first sheet with the side and bottom edges attached to the side and bottom edges of said backing element; and a third transparent flexible sheet mounted on the side of said backing element opposite to said one side thereof, the side and bottom edges of said third sheet being attached to the side and bottom edges of said backing element, said transparent sheets forming pouches for retaining said cards and documents.

6. The holder of claim 5 wherein said first and third sheets are substantially the same size and extend over slightly less than the entire length of said backing element.

7. The holder of claim 5 and further including a second backing element similar to the first backing element, said second backing element having pouches formed therein in the same manner as said first backing element, and means for joining said backing elements together along one of the edges of each, said joining means being flexible and permitting said backing elements to either be closed in abutment against each other or opened away from each other.

* * * * *